US009214751B2

(12) United States Patent
Kenzaki et al.

(10) Patent No.: US 9,214,751 B2
(45) Date of Patent: Dec. 15, 2015

(54) COAXIAL CONNECTOR PLUG AND COAXIAL CONNECTOR RECEPTACLE

(71) Applicant: MURATA MANUFACTURING CO., LTD., Kyoto-fu (JP)

(72) Inventors: Shinichi Kenzaki, Kyoto (JP); Hiroki Wakamatsu, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/226,716

(22) Filed: Mar. 26, 2014

(65) Prior Publication Data

US 2014/0206228 A1 Jul. 24, 2014

Related U.S. Application Data

(63) Continuation of application No. PCT/JP2012/065854, filed on Jun. 21, 2012.

(30) Foreign Application Priority Data

Sep. 28, 2011 (JP) ..... 2011-212042

(51) Int. Cl.

| | |
|---|---|
| ***H01R 13/193*** | (2006.01) |
| ***H01R 12/57*** | (2011.01) |
| ***H01R 24/50*** | (2011.01) |
| ***H01R 9/05*** | (2006.01) |
| *H01R 103/00* | (2006.01) |

(52) U.S. Cl.

CPC ..... *H01R 13/193* (2013.01); *H01R 9/05* (2013.01); *H01R 12/57* (2013.01); *H01R 24/50* (2013.01); *H01R 2103/00* (2013.01)

(58) Field of Classification Search

CPC ..... H01R 13/6272; H01R 13/6275

See application file for complete search history.

(56) References Cited

U.S. PATENT DOCUMENTS 5,772,470 A * 6/1998 Togashi ..... 439/582
7,048,547 B2 * 5/2006 Gottwald ..... 439/63

(Continued)

FOREIGN PATENT DOCUMENTS

JP 08-279377 A 10/1996
JP 2001-283998 A 10/2001

(Continued)

OTHER PUBLICATIONS

International Search Report; PCT/JP2012/065854; Aug. 28, 2012.

(Continued)

*Primary Examiner* — Gary Paumen
(74) *Attorney, Agent, or Firm* — Studebaker & Brackett PC

(57) ABSTRACT

A coaxial connector plug and a coaxial connector receptacle that may be stably suctioned by a suction nozzle. A coaxial connector receptacle including a substantially cylindrical outer conductor and a center conductor surrounded by the outer conductor is mountable to a coaxial connector plug. An outer conductor has a substantially cylindrical shape extending in the z-axis direction, and is provided with a slit that connects between the upper end and the lower end of the outer conductor. A center conductor is surrounded by the outer conductor. A projection is positioned in the slit. The outer conductor of the coaxial connector receptacle is inserted into the outer conductor from the negative side in the z-axis direction. The center conductor of the coaxial connector receptacle is connected to the center conductor.

5 Claims, 6 Drawing Sheets

(56) References Cited

U.S. PATENT DOCUMENTS

| | | | | |
|---|---|---|---|---|
| 2001/0027033 | A1 | 10/2001 | Fujimoto et al. | |
| 2004/0102061 | A1* | 5/2004 | Watanabe | 439/63 |
| 2006/0024985 | A1 | 2/2006 | Nagata et al. | |
| 2006/0199401 | A1* | 9/2006 | Duquerroy et al. | 439/63 |
| 2008/0254676 | A1* | 10/2008 | Chien et al. | 439/581 |
| 2009/0117779 | A1* | 5/2009 | Zhang | 439/581 |
| 2009/0149063 | A1 | 6/2009 | Yotsutani | |
| 2009/0298333 | A1* | 12/2009 | Yotsutani | 439/581 |
| 2010/0227481 | A1* | 9/2010 | Liao et al. | 439/63 |
| 2012/0122339 | A1 | 5/2012 | Taguchi | |

FOREIGN PATENT DOCUMENTS

| | | | |
|---|---|---|---|
| JP | 2003-035736 | A | 2/2003 |
| JP | 2006-066384 | A | 3/2006 |
| JP | 2009-140687 | A | 6/2009 |
| JP | 2010-009750 | A | 1/2010 |
| TW | 488116 | B | 5/2002 |
| TW | M334540 | U | 6/2008 |
| WO | 2010/008884 | A1 | 1/2010 |
| WO | 2011/013747 | A1 | 2/2011 |

OTHER PUBLICATIONS

Written Opinion of the International Searching Authority; PCT/JP2012/065854; Aug. 28, 2012.

An Office Letter; "Preliminary Examination Report," issued by the Taiwanese Intellectual Property Office on Jul. 10, 2014, which corresponds to Taiwanese Patent Application No. 101124602 and is related to U.S. Appl. No. 14/226,716.

* cited by examiner

COAXIAL CONNECTOR PLUG AND COAXIAL CONNECTOR RECEPTACLE

CROSS REFERENCE TO RELATED APPLICATIONS

This application claims benefit of priority to Japanese Patent Application No. 2011-212042 filed on Sep. 28, 2011, and to International Patent Application No. PCT/JP2012/065854 filed on Jun. 21, 2012, the entire content of which is incorporated herein by reference.

TECHNICAL FIELD

The present technical field relates to a coaxial connector plug and a coaxial connector receptacle, and more specifically to a coaxial connector plug and a coaxial connector receptacle including a substantially tubular outer conductor and a center conductor surrounded by the outer conductor.

BACKGROUND

A coaxial connector device described in Japanese Unexamined Patent Application Publication No. 2009-140687, for example, is known as a coaxial connector plug according to the related art. FIG. 13 is a perspective view showing the appearance of a coaxial connector device 500.

As shown in FIG. 13, the coaxial connector device 500 includes a signal-connection contact conductor 502, a ground-connection contact conductor 504, and an insulating substrate 506. The insulating substrate 506 is a base member that has a substantially rectangular shape as viewed in plan. The signal-connection contact conductor 502 projects upward from the center of the insulating substrate 506. The ground-connection contact conductor 504 has a substantially cylindrical shape to surround the periphery of the signal-connection contact conductor 502. The ground-connection contact conductor 504 is provided with a slit 508 that extends in the up-down direction.

The coaxial connector device 500 configured as described above is connected to a mating coaxial connector device. Specifically, a ground contact conductor of the mating coaxial connector device is inserted into the ground-connection contact conductor 504. Since the ground-connection contact conductor 504 is provided with the slit 508, the ground-connection contact conductor 504 may be easily deformed. As a result, the ground contact conductor of the mating coaxial connector device is easily inserted into the ground-connection contact conductor 504.

However, it is difficult for a suction nozzle to stably suction the coaxial connector device 500 described in Japanese Unexamined Patent Application Publication No. 2009-140687 during mounting. More particularly, when mounting the coaxial connector device 500 to a circuit substrate, the coaxial connector device 500 is suctioned by a suction nozzle, and aligned on the circuit substrate. After that, the coaxial connector device 500 is fixed to the circuit substrate by soldering or the like. Since the ground-connection contact conductor 504 of the coaxial connector device 500 is provided with the slit 508, however, air may enter the ground-connection contact conductor 504 through the slit 508 when the coaxial connector device 500 is suctioned by the suction nozzle. Therefore, the coaxial connector device 500 may not be stably suctioned by the suction nozzle.

SUMMARY

Technical Problem

It is therefore an object of the present disclosure to provide a coaxial connector plug and a coaxial connector receptacle that may be stably suctioned by a suction nozzle.

Solution to Problem

An aspect of the present disclosure provides a coaxial connector plug to which a coaxial connector receptacle is mountable, the coaxial connector receptacle including a substantially tubular first outer conductor and a first center conductor surrounded by the first outer conductor, the coaxial connector plug including: a second outer conductor formed in a substantially tubular shape extending in an up-down direction and provided with a slit that connects between an upper end and a lower end of the second outer conductor; a second center conductor surrounded by the second outer conductor; and a lid member positioned in the slit, characterized in that the first outer conductor is inserted into the second outer conductor from a lower side, and the first center conductor is connected to the second center conductor.

An aspect of the present disclosure provides a coaxial connector receptacle to which a coaxial connector plug is mountable, the coaxial connector plug including a substantially tubular second outer conductor and a second center conductor surrounded by the second outer conductor, the coaxial connector receptacle including: a first outer conductor formed in a substantially tubular shape extending in an up-down direction and provided with a slit that connects between an upper end and a lower end of the first outer conductor; a first center conductor surrounded by the first outer conductor; and a lid member provided in the slit, characterized in that the first outer conductor is inserted into the second outer conductor from a lower side, and the second center conductor is connected to the first center conductor.

Advantageous Effects of Disclosure

According to the present disclosure, the coaxial connector plug and the coaxial connector receptacle may be stably suctioned by a suction nozzle.

DETAILED DESCRIPTION

A coaxial connector plug and a coaxial connector receptacle according to an embodiment of the present disclosure will be described below.

Configuration of Coaxial Connector Plug

Figure 1:
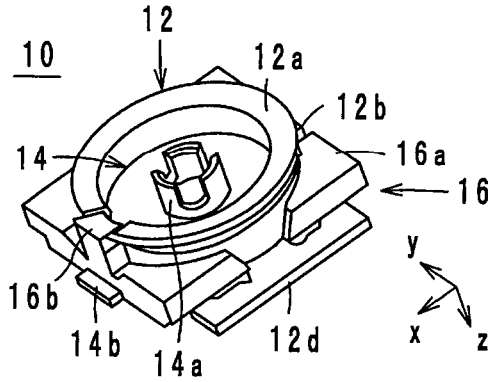
FIG. 1 is a perspective view showing the appearance of a coaxial connector plug according to an embodiment of the present disclosure.
Figure 2:
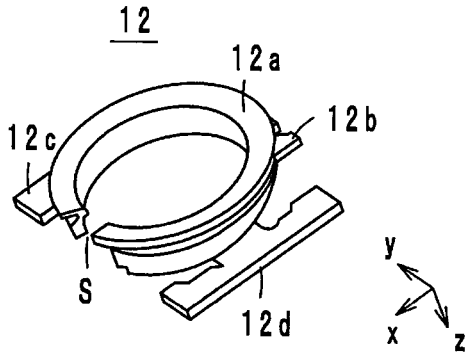
FIG. 2 is a perspective view showing the appearance of an outer conductive portion of the coaxial connector plug.
Figure 3:
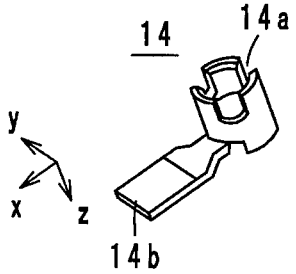
FIG. 3 is a perspective view showing the appearance of a center conductive portion of the coaxial connector plug.
Figure 4:
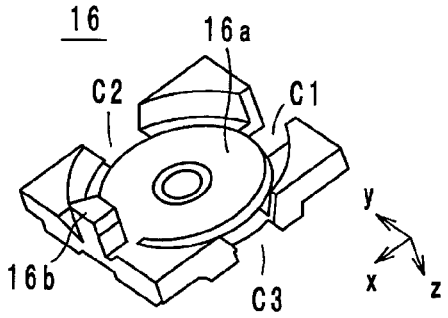
FIG. 4 is a perspective view showing the appearance of an insulator of the coaxial connector plug.
Figure 5:
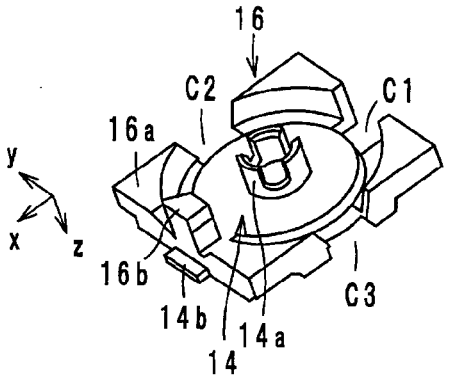
FIG. 5 is a perspective view showing the appearance of the center conductive portion and the insulator as assembled.

First, a coaxial connector plug according to an embodiment of the present disclosure will be described with reference to the drawings. FIG. 1 is a perspective view showing the appearance of a coaxial connector plug 10 according to an embodiment of the present disclosure. FIG. 2 is a perspective view showing the appearance of an outer conductive portion 12 of the coaxial connector plug 10. FIG. 3 is a perspective view showing the appearance of a center conductive portion 14 of the coaxial connector plug 10. FIG. 4 is a perspective view showing the appearance of an insulator 16 of the coaxial connector plug 10. FIG. 5 is a perspective view showing the appearance of the center conductive portion 14 and the insulator 16 as assembled.

In the following description, in FIG. 1, the direction of the normal to the insulator 16 is defined as a "z-axis direction", and the directions parallel to the two sides of the insulator 16 as viewed from the z-axis direction are defined as an "x-axis direction" and a "y-axis direction". The x-axis direction, the y-axis direction, and the z-axis direction are orthogonal to each other. The z-axis direction is parallel to the direction of a plumb line.

It should be noted that a coaxial connector receptacle to be discussed later is mounted to the coaxial connector plug 10 from the lower side. That is, the coaxial connector plug 10 is used with its opening facing downward. Thus, the lower side of FIG. 1 corresponds to the upper side in the direction of the plumb line, and the upper side of FIG. 1 corresponds to the lower side in the direction of the plumb line. Thus, the lower side of FIG. 1 is defined as a "positive side" in the z-axis direction, and the upper side of FIG. 1 is defined as a "negative side" in the z-axis direction.

The coaxial connector plug 10 is mounted on a circuit substrate such as a flexible printed substrate, and includes the outer conductive portion 12, the center conductive portion 14, and the insulator 16 as shown in FIG. 1.

The outer conductive portion 12 is fabricated by performing a punching process and a bending process on a single metal plate (made of phosphor bronze, for example) having conductivity and elasticity. Further, the outer conductive portion 12 is plated with silver or gold. As shown in FIGS. 1 and 2, the outer conductive portion 12 includes an outer conductor 12*a* and outer terminals 12*b* to 12*d*. As shown in FIGS. 1 and 2, the outer conductor 12*a* has a substantially cylindrical shape extending in the z-axis direction.

A slit S is provided in the outer conductor 12*a*. The slit S is provided to linearly connect between an end portion (upper end) of the outer conductor 12*a* on the positive side in the z-axis direction and an end portion (lower end) of the outer conductor 12*a* on the negative side in the z-axis direction. Thus, the outer conductor 12*a* is substantially C-shaped, rather than being continuous to form a substantially annular shape, as viewed in plan from the negative side in the z-axis direction.

The outer terminals 12*b* to 12*d* are connected to the outer conductor 12*a*, and provided on the positive side in the z-axis direction with respect to the outer conductor 12*a*. The outer terminal 12*b* is extended from the outer conductor 12*a* toward the positive side in the z-axis direction, and is bent toward the negative side in the x-axis direction. The outer terminal 12*c* is extended from the outer conductor 12*a* toward the positive side in the z-axis direction, and is bent toward the positive side in the y-axis direction. The outer terminal 12*c* is substantially T-shaped as viewed in plan from the z-axis direction. The outer terminal 12*d* is extended from the outer conductor 12*a* toward the positive side in the z-axis direction, and is bent toward the negative side in the y-axis direction. The outer terminal 12*d* is substantially T-shaped as viewed in plan from the z-axis direction.

The center conductive portion 14 is fabricated by performing a punching process and a bending process on a single metal plate (made of phosphor bronze, for example). Further, the center conductive portion 14 is plated with silver or gold. As shown in FIGS. 1 and 3, the center conductive portion 14 includes a center conductor 14*a* and an outer terminal 14*b*.

As shown in FIG. 1, the center conductor 14*a* is provided to extend in the z-axis direction at the center of the outer conductor 12*a*. That is, the center conductor 14*a* is surrounded by the outer conductor 12*a* as viewed in plan from the z-axis direction. As shown in FIG. 3, the center conductor 14*a* has a substantially cylindrical shape extending in the z-axis direction. The center conductor 14*a* is provided with three slits extending in the up-down direction. This enables the center conductor 14*a* to be slightly expanded in the horizontal direction.

As shown in FIG. 3, the outer terminal 14*b* is connected to an end portion of the center conductor 14*a* on the positive side in the z-axis direction, and extends toward the positive side in the x-axis direction. As shown in FIG. 1, the outer terminal 14*b* is located opposite to the outer terminal 12*b* across the center of the outer conductor 12*a* as viewed in plan from the z-axis direction.

As shown in FIGS. 1 and 4, the insulator 16 is a base member fabricated from an insulating material such as a resin, and includes a base portion 16*a* and a projection 16*b*. The base portion 16*a* has a substantially rectangular shape as viewed in plan from the z-axis direction. It should be noted that the base portion 16*a* is provided with notches C1 to C3. The notch C1 is formed by removing the center portion of a side of the base portion 16*a* on the negative side in the x-axis direction. The notch C2 is formed by removing the center portion of a side of the base portion 16*a* on the positive side in the y-axis direction. The notch C3 is formed by removing the center portion of a side of the base portion 16*a* on the negative side in the y-axis direction.

The projection 16*b* is formed by the center portion of a side of the base portion 16*a* on the positive side in the x-axis direction projecting on the negative side in the z-axis direction.

The center conductive portion 14 and the insulator 16 are integrally formed by insert molding. The center conductor 14*a* is thus projected from the center of the base portion 16*a* toward the negative side in the z-axis direction. Further, on the positive side in the z-axis direction with respect to the projection 16*b*, the outer terminal 14*b* of the center conductive portion 14 is extended from the insulator 16 toward the positive side in the x-axis direction.

The outer conductive portion 12 is attached to the insulator 16. More particularly, the outer terminals 12*b* to 12*d* are extended toward the positive side in the z-axis direction with respect to the insulator 16 via the notches C1 to C3, respectively. An end portion of the outer conductor 12*a* on the positive side in the z-axis direction is covered by the base portion 16*a* of the insulator 16. As shown in FIG. 1, the projection 16*b* is positioned in the slit S. That is, the projection 16*b* functions as a lid member to block the slit S. It should be noted, however, that the projection 16*b* does not contact the outer conductor 12*a*. That is, a slight gap is present between the projection 16*b* and the outer conductor 12*a*. This allows the outer conductor 12*a* to be slightly deformed in the direction of reducing its diameter.

Coaxial Connector Receptacle

Figure 6:
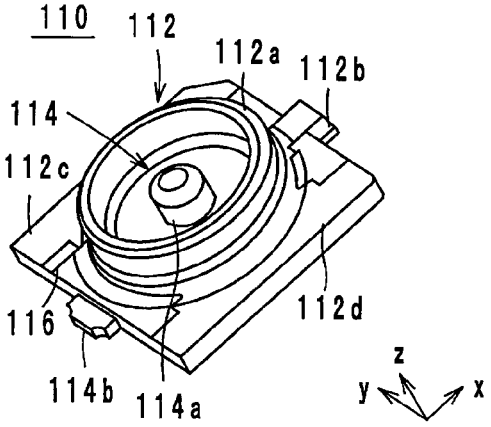
FIG. 6 is a perspective view showing the appearance of a coaxial connector receptacle according to an embodiment of the present disclosure.
Figure 7:
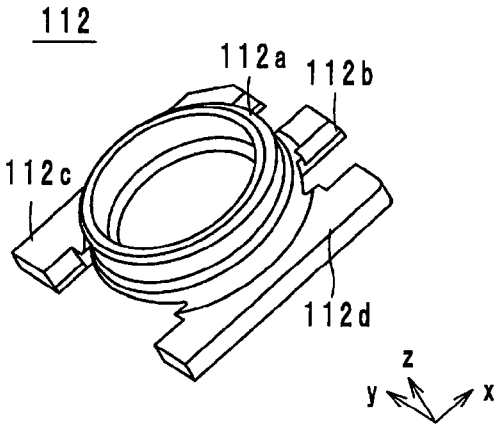
FIG. 7 is a perspective view showing the appearance of an outer conductive portion of the coaxial connector receptacle.
Figure 8:
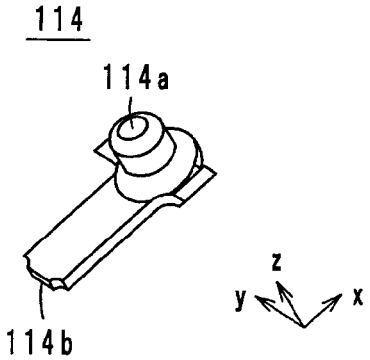
FIG. 8 is a perspective view showing the appearance of a center conductive portion of the coaxial connector receptacle.
Figure 9:
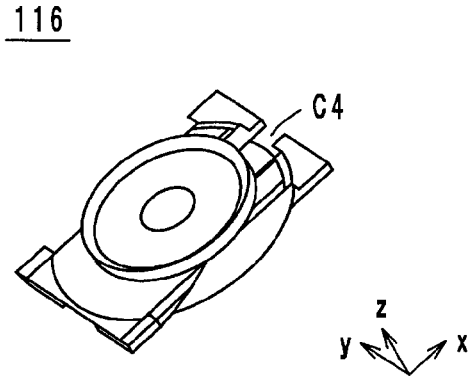
FIG. 9 is a perspective view showing the appearance of an insulator of the coaxial connector receptacle.

Next, a coaxial connector receptacle to be mounted to the coaxial connector plug 10 according to an embodiment of the present disclosure will be described with reference to the drawings. FIG. 6 is a perspective view showing the appearance of a coaxial connector receptacle 110 according to an embodiment of the present disclosure. FIG. 7 is a perspective view showing the appearance of an outer conductive portion 112 of the coaxial connector receptacle 110. FIG. 8 is a perspective view showing the appearance of a center conductive portion 114 of the coaxial connector receptacle 110. FIG. 9 is a perspective view showing the appearance of an insulator 116 of the coaxial connector receptacle 110.

In the following description, in FIG. 6, the direction of the normal to the insulator 116 is defined as a "z-axis direction", and the directions parallel to the two sides of the insulator 116 as viewed from the z-axis direction are defined as an "x-axis direction" and a "y-axis direction". The x-axis direction, the y-axis direction, and the z-axis direction are orthogonal to each other. The z-axis direction is parallel to the direction of the plumb line.

It should be noted that the coaxial connector receptacle 110 is mounted to the coaxial connector plug 10 from the lower side. That is, the coaxial connector receptacle 110 is used with its opening facing upward. Thus, the upper side of FIG. 6 corresponds to the upper side in the direction of the plumb line, and the lower side of FIG. 6 corresponds to the lower side in the direction of the plumb line. Thus, the upper side of FIG. 6 is defined as a "positive side" in the z-axis direction, and the lower side of FIG. 6 is defined as a "negative side" in the z-axis direction.

The coaxial connector receptacle 110 is mounted on a circuit substrate such as a flexible printed substrate, and includes the outer conductive portion 112, the center conductive portion 114, and the insulator 116 as shown in FIG. 6.

The outer conductive portion 112 is fabricated by performing a punching process and a bending process on a single metal plate (made of phosphor bronze, for example) having conductivity and elasticity. Further, the outer conductive portion 112 is plated with silver or gold. As shown in FIGS. 6 and 7, the outer conductive portion 112 includes an outer conductor 112*a* and outer terminals 112*b* to 112*d*. As shown in FIGS. 6 and 7, the outer conductor 112*a* has a substantially cylindrical shape extending in the z-axis direction.

The outer terminals 112*b* to 112*d* are connected to the outer conductor 112*a*, and provided on the negative side in the z-axis direction with respect to the outer conductor 112*a*. The outer terminal 112*b* is extended from the outer conductor 112*a* toward the negative side in the z-axis direction, and is bent toward the positive side in the x-axis direction. The outer terminal 112*c* is extended from the outer conductor 112*a* toward the negative side in the z-axis direction, and is bent toward the positive side in the y-axis direction. The outer terminal 112*c* is substantially T-shaped as viewed in plan from the z-axis direction. The outer terminal 112*d* is extended from the outer conductor 112*a* toward the negative side in the z-axis direction, and is bent toward the negative side in the y-axis direction. The outer terminal 112*d* is substantially T-shaped as viewed in plan from the z-axis direction.

The center conductive portion 114 is fabricated by performing a punching process and a bending process on a single metal plate (made of phosphor bronze, for example). Further, the center conductive portion 114 is plated with silver or gold. As shown in FIGS. 6 and 8, the center conductive portion 114 includes a center conductor 114*a* and an outer terminal 114*b*.

As shown in FIG. 6, the center conductor 114*a* is provided to extend in the z-axis direction at the center of the outer conductor 112*a*. That is, the center conductor 114*a* is surrounded by the outer conductor 112*a* as viewed in plan from the z-axis direction. As shown in FIG. 8, the center conductor 114*a* has a substantially columnar shape extending in the z-axis direction.

As shown in FIG. 8, the outer terminal 114*b* is connected to an end portion of the center conductor 114*a* on the negative side in the z-axis direction, and extends toward the negative side in the x-axis direction. As shown in FIG. 6, the outer terminal 114*b* is located opposite to the outer terminal 112*b* across the center of the outer conductor 112*a* as viewed in plan from the z-axis direction.

The insulator 116 is fabricated from an insulating material such as a resin, and is substantially rectangular as viewed in plan from the z-axis direction as shown in FIGS. 6 and 9. It should be noted that the insulator 116 is provided with a notch C4. The notch C4 is formed by removing the center portion of a side of the insulator 116 on the positive side in the x-axis direction.

The outer conductive portion 112, the center conductive portion 114, and the insulator 116 are integrally formed by insert molding. The outer conductor 112*a* is thus projected from the center of the insulator 116 toward the positive side in the z-axis direction. Further, an end portion of the outer conductor 112*a* on the negative side in the z-axis direction is covered by the insulator 116. The outer terminal 112*b* is extended to the outside of the insulator 116 via the notch C4. Further, the outer terminals 112*c* and 112*d* are extended from a side of the insulator 116 on the positive side in the y-axis direction and a side of the insulator 116 on the negative side in the y-axis direction, respectively. The center conductor 114*a* is projected from the insulator 116 toward the positive side in the z-axis direction in a region surrounded by the outer conductor 112*a*. The outer terminal 114*b* is extended from the insulator 116 toward the positive side in the x-axis direction.

Attachment of Coaxial Connector Receptacle to Coaxial Connector Plug

Figure 10A:
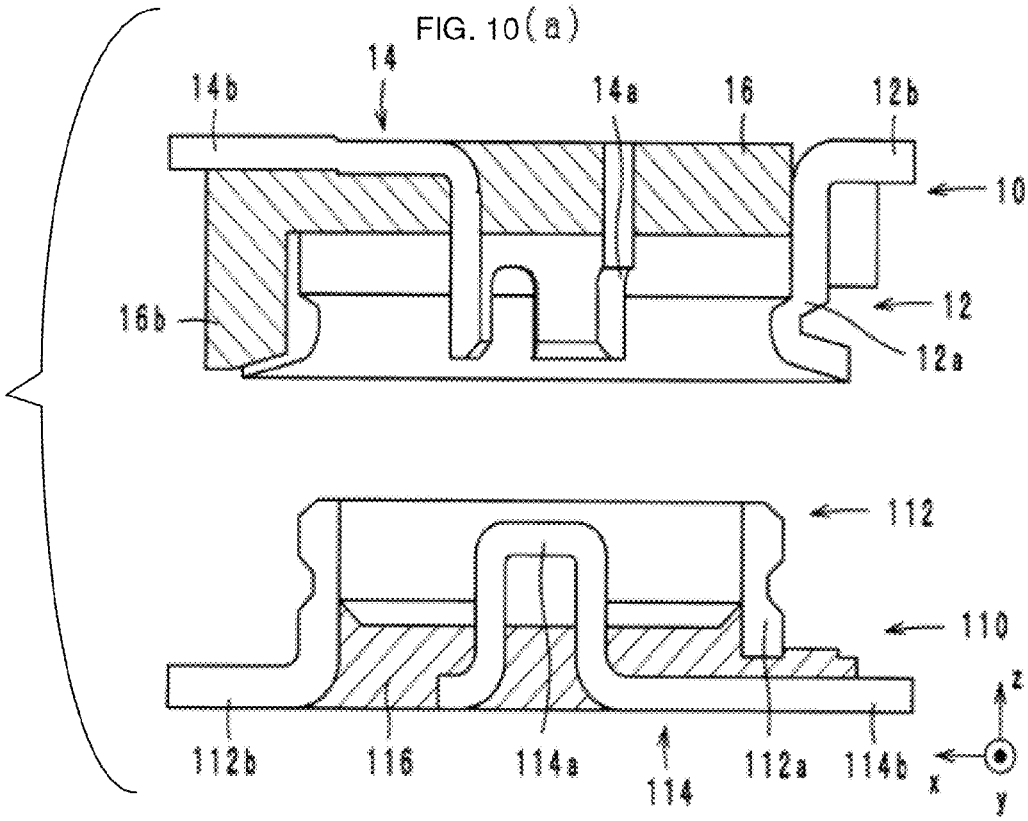
FIG. 10(*a*) is a cross-sectional view showing the structure of the coaxial connector plug and the coaxial connector receptacle before attachment, and FIG. 10(*b*) is a cross-sectional view showing the structure of the coaxial connector plug and the coaxial connector receptacle after attachment.
Figure 10B:
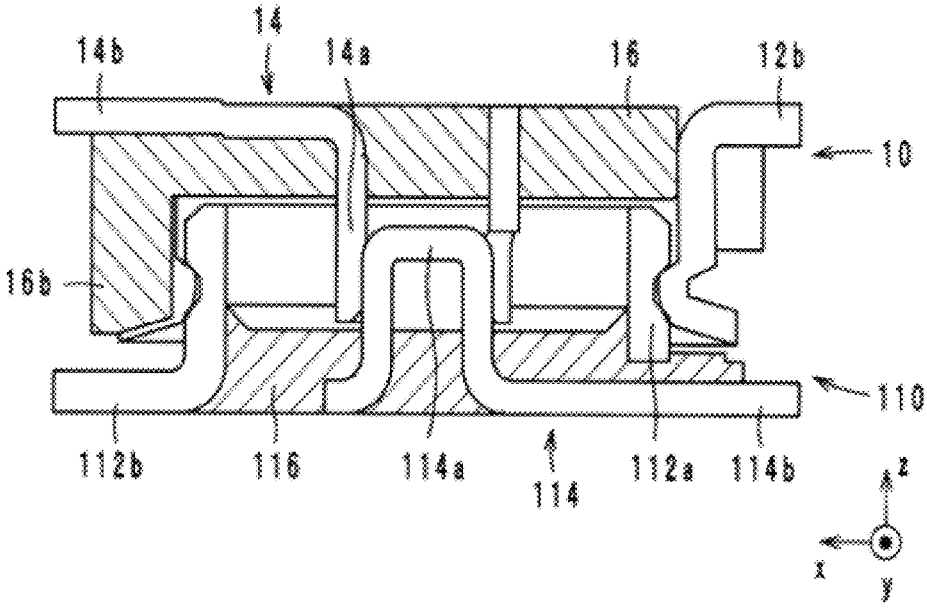

Attachment of the coaxial connector receptacle 110 to the coaxial connector plug 10 will be described below with reference to the drawings. FIG. 10(*a*) is a cross-sectional view showing the structure of the coaxial connector plug 10 and the coaxial connector receptacle 110 before attachment. FIG. 10(*b*) is a cross-sectional view showing the structure of the coaxial connector plug 10 and the coaxial connector receptacle 110 after attachment.

As shown in FIG. 10(*a*), the coaxial connector plug 10 is used with the opening of the outer conductor 12*a* facing the negative side in the z-axis direction. Then, as shown in FIG. 10(*b*), the coaxial connector receptacle 110 is mounted to the coaxial connector plug 10 from the negative side in the z-axis direction. Specifically, the outer conductor 112*a* is inserted into the outer conductor 12*a* from the negative side in the z-axis direction. The diameter of the outer peripheral surface of the outer conductor 112*a* is designed to be slightly larger than the diameter of the inner peripheral surface of the outer conductor 12*a*. Therefore, the outer peripheral surface of the outer conductor 112*a* is brought into pressure contact with the inner peripheral surface of the outer conductor 12*a*, and the outer conductor 12*a* is pressed to be expanded in the horizontal direction by the outer conductor 112*a*. That is, the outer conductor 12*a* is expanded such that the width of the entire slit S becomes larger. Then, projections and depressions on the inner peripheral surface of the outer conductor 12*a* and projections and depressions on the outer peripheral surface of the outer conductor 112*a* engage each other. This allows the outer conductor 12*a* to hold the outer conductor 112*a*. The outer conductors 12*a* and 112*a* are kept at a ground potential during use.

Further, the center conductor 14*a* is connected to the center conductor 114*a*. Specifically, as shown in FIG. 10(*b*), the center conductor 114*a* is inserted into the substantially cylindrical center conductor 14*a*. The diameter of the outer peripheral surface of the center conductor 114*a* is designed to be slightly larger than the diameter of the inner peripheral surface of the center conductor 14*a*. Therefore, the outer peripheral surface of the center conductor 114*a* is brought into pressure contact with the inner peripheral surface of the center conductor 14*a*, and the center conductor 14*a* is pressed to be expanded so as to be warped in the horizontal direction by the center conductor 114*a*. This allows the center conductor 14*a* to hold the center conductor 114*a*. A signal current flows through the center conductors 14*a* and 114*a* during use.

Effect

Figure 11:
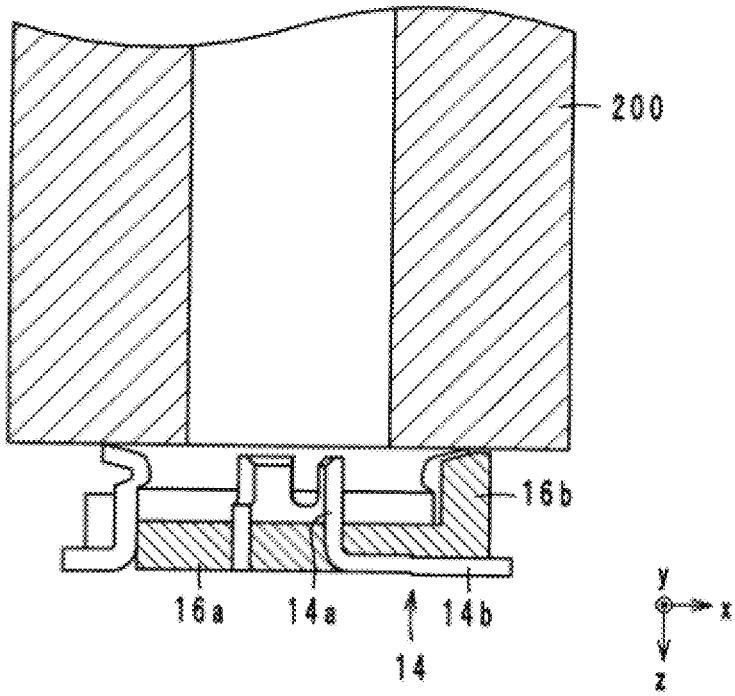
FIG. 11 is a cross-sectional view showing the structure of the coaxial connector plug suctioned by a suction nozzle.

The coaxial connector plug 10 configured as described above may be stably suctioned by a suction nozzle during mounting. FIG. 11 is a cross-sectional view showing the structure of the coaxial connector plug 10 suctioned by a suction nozzle 200.

In the coaxial connector device 500 described in Japanese Unexamined Patent Application Publication No. 2009-140687, the ground-connection contact conductor 504 is provided with the slit 508, and thus air may enter the ground-connection contact conductor 504 through the slit 508 when the coaxial connector device 500 is suctioned by the suction nozzle. Therefore, the coaxial connector device 500 may not be stably suctioned by the suction nozzle.

On the other hand, the coaxial connector plug 10 is provided with the projection 16*b* positioned in the slit S as shown in FIGS. 1 and 11. Consequently, even if air in the outer conductor 112*a* is suctioned by the suction nozzle 200 as shown in FIG. 11, air is not likely to enter the outer conductor 112*a* via the slit S since the slit S is blocked by the projection 16*b*. As a result, the coaxial connector plug 10 is stably suctioned by the suction nozzle 200.

In the coaxial connector plug 10, in addition, on the positive side in the z-axis direction with respect to the projection 16*b*, the outer terminal 14*b* is extended from the insulator 16 toward the positive side in the x-axis direction. Consequently, the projection 16*b* fabricated from an insulating material is present between the outer conductor 12*a* and the outer terminal 14*b*. As a result, insulation between the outer conductor 12*a* and the outer terminal 14*b* is improved, which suppresses occurrence of a short circuit between the outer conductor 12*a* and the outer terminal 14*b*.

Modification

Figure 12:
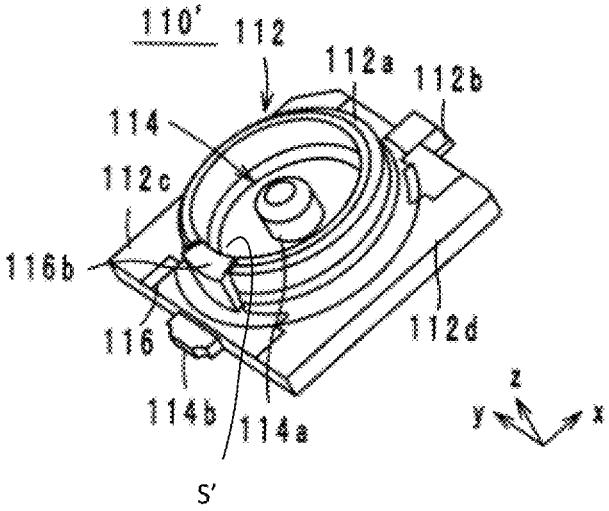
FIG. 12 is a perspective view showing the appearance of a coaxial connector receptacle according to a modification.
Figure 13:
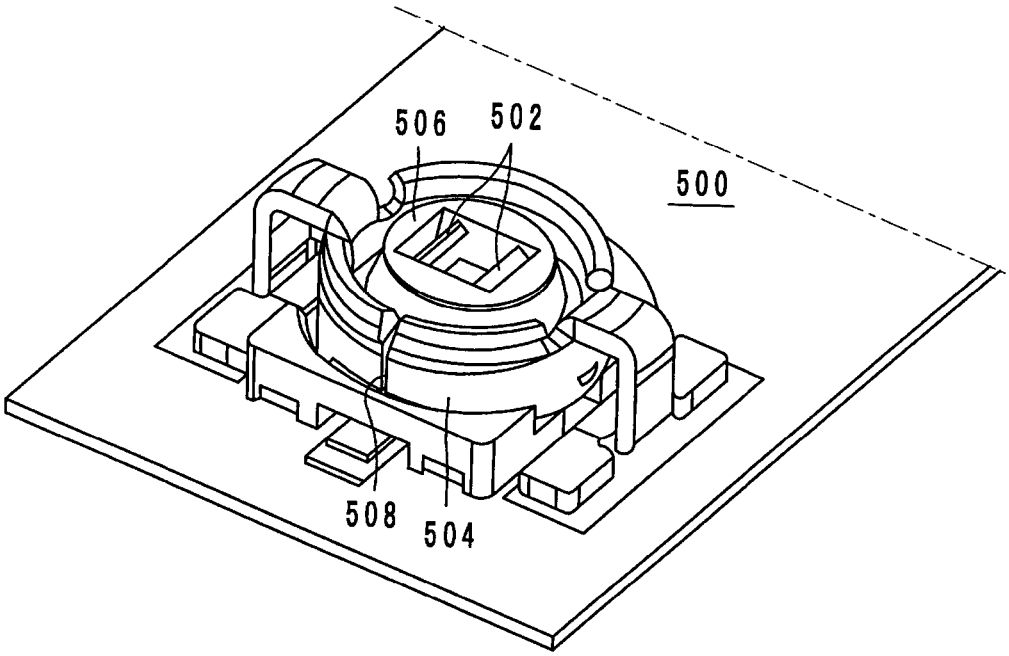
FIG. 13 PRIOR ART
FIG. 13 is a perspective view showing the appearance of a coaxial connector device described in Japanese Unexamined Patent Application Publication No. 2009-140687.

A coaxial connector receptacle 110' according to a modification will be described below with reference to the drawing. FIG. 12 is a perspective view showing the appearance of a coaxial connector receptacle 110' according to a modification.

As shown in FIG. 12, a slit S' is provided in the outer conductor 112*a* of the coaxial connector receptacle 110'. The insulator 116 includes a projection 116*b* provided in the vicinity of a side of the insulator 116 on the negative side in the x-axis direction to project toward the positive side in the z-axis direction. The projection 116*b* is positioned in the slit S'. The thus configured coaxial connector receptacle 110' is also stably suctioned by a suction nozzle as with the coaxial connector plug 10.

INDUSTRIAL APPLICABILITY

As has been described above, the present disclosure is useful for a coaxial connector plug and a coaxial connector receptacle, and particularly excellent in that the coaxial connector plug and coaxial connector receptacle may be stably suctioned by a suction nozzle.

The invention claimed is:

1. A coaxial connector plug to which a coaxial connector receptacle is mountable, the coaxial connector receptacle including a substantially tubular first outer conductor and a first center conductor surrounded by the first outer conductor, the coaxial connector plug comprising:

a second outer conductor formed in a substantially tubular shape extending in an up-down direction and provided with a slit, the slit extending entirely between an upper end and a lower end of a tubular portion of the second outer conductor;

a second center conductor surrounded by the second outer conductor; and a lid member positioned in the slit, the first outer conductor being inserted into the second outer conductor, and the first center conductor being connected to the second center conductor.

2. The coaxial connector plug according to claim 1, further comprising:

a base member provided to cover the upper end of the second outer conductor, and the lid member is part of the base member.

3. The coaxial connector plug according to claim 1, wherein the lid member and the second outer conductor are spaced from each other.

4. A coaxial connector plug to which a coaxial connector receptacle is mountable, the coaxial connector receptacle including a substantially tubular first outer conductor and a first center conductor surrounded by the first outer conductor, the coaxial connector plug comprising:

a second outer conductor formed in a substantially tubular shape extending in an up-down direction and provided with a slit, the slit extending between an upper end and a lower end of the second outer conductor;

a second center conductor surrounded by the second outer conductor; and a lid member positioned in the slit, the first outer conductor being inserted into the second outer conductor, and the first center conductor being connected to the second center conductor, and further comprising:

an outer terminal for the second center conductor that is connected to the second center conductor; and an outer terminal for the second outer conductor that is connected to the second outer conductor, the lid member is an insulating material, and the outer terminal for the second center conductor is provided on an upper side of the lid member.

5. A coaxial connector receptacle to which a coaxial connector plug is mountable, the coaxial connector plug including a substantially tubular second outer conductor and a second center conductor surrounded by the second outer conductor, the coaxial connector receptacle comprising:

a first outer conductor formed in a substantially tubular shape extending in an up-down direction and provided with a slit, the slit connecting an upper end and a lower end of the first outer conductor;

a first center conductor surrounded by the first outer conductor; and a lid member provided in the slit, the first outer conductor being inserted into the second outer conductor, and the second center conductor being connected to the first center conductor.

* * * * *